United States Patent [19]

Wood

[11] Patent Number: 4,462,140

[45] Date of Patent: Jul. 31, 1984

[54] PNEUMATIC LEVELING DEVICE FOR FIBER FEEDING APPARATUS

[75] Inventor: Dennis E. Wood, Fairport, N.Y.

[73] Assignee: Rando Machine Corporation, Macedon, N.Y.

[21] Appl. No.: 415,370

[22] Filed: Sep. 7, 1982

[51] Int. Cl.[3] ..... D01G 15/40

[52] U.S. Cl. ..... 19/105; 406/181

[58] Field of Search ..... 19/105; 406/181

[56] References Cited

U.S. PATENT DOCUMENTS

| | | | |
|---|---|---|---|
| 3,243,181 | 3/1966 | Lyman | 406/181 X |
| 3,431,027 | 3/1969 | Kochey | 406/181 |
| 3,458,237 | 7/1969 | Noe | 406/181 X |
| 3,567,288 | 3/1971 | Wood | 19/65 A |
| 3,787,093 | 1/1974 | Hanselmann et al. | 406/181 |
| 3,865,439 | 2/1975 | Moser et al. | 406/181 X |
| 3,963,111 | 6/1976 | Harrell et al. | 19/105 X |
| 4,009,803 | 3/1977 | Lytton et al. | 19/105 X |
| 4,030,635 | 6/1977 | Hablutzel et al. | 19/105 X |
| 4,165,134 | 8/1979 | Payne | 406/181 X |
| 4,240,180 | 12/1980 | Wood et al. | 19/105 |

*Primary Examiner*—Louis Rimrodt

*Attorney, Agent, or Firm*—Shlesinger, Fitzsimmons & Shlesinger

[57] ABSTRACT

The leveling device comprises a rectangular duct connected at its inlet end to a pneumatic fiber supply and at its outlet end to the upper end of a feed chute for a carding machine. A pair of opposed accelerator plates are adjustably mounted adjacent the duct's inlet end to accelerate the incoming stream of fibers, which then passes between two deflector nozzles that are mounted with their discharge ends opening on opposite sides of the duct, and with their outer or inlet ends connected to opposite ends of a flexible, generally U-shaped tube. Downstream from the nozzles the opposed sidewalls of the duct curve outwardly and away from each other to form a diffusion section, the enlarged end of which is connected to the upper end of the feed chute. In use the air pressure at the outlet end of each nozzle alternately rises and falls causing the stream of fibers to be deflected alternately toward one and then the other of the opposed, curved sidewalls of the duffusion chamber. The stream adheres briefly to each curved sidewall before being directed back toward the other, thereby directing fibers to the opposite side of the chute. The U-shaped tube has corrugated legs which permit the tube to be increased or decreased in length, thereby to increase or decrease, respectively, the frequency with which the stream of fibers is directed back and forth toward opposite sides of the chute.

12 Claims, 8 Drawing Figures

PNEUMATIC LEVELING DEVICE FOR FIBER FEEDING APPARATUS

BACKGROUND OF THE INVENTION

This invention relates to apparatus for feeding fibers to a carding machine or the like, and more particularly to a pneumatic device for leveling the upper end of a column of fibers deposited in the fiber feeding chute of such machine.

In most pneumatic fiber supply systems of the type described, it is conventional to divert air-borne fibers from an overhead supply or transport duct downwardly into each of a plurality of vertically disposed fiber feed chutes, the lower ends of which are connected with the inputs of carding machines and the like. If such fibers are allowed to accumulate in the center of each chute and then fall by gravity toward its extremities, obviously the height of the column of fibers will be substantially greater at its center as compared to its extremities, and as a consequence the compaction or density of the column of fibers will be greatest at its center and lesser toward its extremities. This makes it extremely difficult to insure that a uniform supply of fibers will be fed from the lower end of each chute into the associated carding machine.

For this reason it is most desirable that fibers be fed downwardly into an associated feed chute in such manner that the upper end of the column of fibers in the chute has a level or uniform profile. For this purpose efforts have been made to produce apparatus which will cause a stream of fibers emanating from an overhead supply duct to be directed back and forth between opposite sides of a supply chute during the filling thereof. For example, U.S. Pat. Nos. 3,787,093 and 3,865,439 each discloses means for producing the uniform filling of a feed chute of the type described with air-borne fibers. The latter patent, which appears to be more pertinent to this invention, suggests that jets of air be introduced selectively to opposite sides of the transport duct so that a stream of fibers will be directed back and forth transversely of the duct during delivery into the feed chute, thus minimizing the tendency of the fibers to build up or concentrate in the center of the chute. Diverting jets of this type have also been disclosed, although for different purposes, by U.S. Pat. Nos. 4,165,134 and 3,458,237. Similar means for controlling the distribution of an air-borne product is disclosed also in U.S. Pat. No. 3,431,027.

Among the disadvantages of the above-noted prior art systems has been the inaccuracy with which a stream of fibers has been diverted from one side to another of a duct. In other words, it has been discovered that the use of air jets alone for diverting the flow of fibers cannot assure that the fiber distribution in the receiving chute will be uniform or satisfactory at all times. Furthermore, in none of these prior art disclosures is there any suggestion of the desirability of interconnecting the jets which control the diversion of a stream of fibers so that uniform diversion can take place automatically.

Accordingly, it is an object of this invention to provide an improved leveling device which is pneumatically operated, and which is capable of accurately diverting the flow of a stream of fibers back and forth in a predetermined pattern during delivery of the fibers into a feed chute or the like.

Still another object of this invention is to provide an improved leveling device of the type described which is operable automatically and repeatedly to divert the flow of a stream of fibers in different directions in order to achieve a uniform distribution of fibers in the receiving chute of the associated apparatus.

A further object of this invention is to provide improved leveling apparatus of the type described which can be readily adjusted to alter the frequency with which a stream of fibers is diverted back and forth between the sides of a supply duct or chute.

Other objects of the invention will be apparent hereinafter from the specification and from the recital of the appended claims, particularly when read in conjunction with the accompanying drawings.

SUMMARY OF THE INVENTION

Interposed between the fiber supply or transport duct, and the upper end of a feed chute for a carding machine, or the like, is a pneumatic connecting duct or flip-flop unit comprising a jet control section and a curved diffuser section. The jet control section communicates at one end with the fiber supply duct, and at its opposite end with the smaller or narrower end of the diffuser section. From its juncture with the jet control section the sidewalls of the diffuser section curve outwardly and away from each other to form an enlarged end of the diffuser section which is connected to the fiber supply chute adjacent its upper end. Two, spaced, opposed accelerator plates project from opposite sides of the jet control section adjacent its inlet end, so that air-borne fibers are accelerated slightly as they pass the plates. Mounted in opposite sides of the jet control section adjacent the discharge ends of the accelerator plates are two, opposed nozzles, the outer ends of which are connected to opposite ends of a generally U-shaped, flexible tube. The tube, which is adjustably mounted in a stationary housing, has corrugated legs which can be extended or retracted to adjust the overall length of the tube.

In use, when air above atmospheric pressure conveys air-borne fibers into the inlet end of the jet control section, fibers are accelerated as they pass the accelerator plates. At this stage one or the other of the two nozzles will, at least initially, have a slight vacuum created at its discharge end, while the discharge end of the other nozzle will be at a higher pressure. Consequently the flow of fibers is deflected away from the nozzle outlet having the higher pressure, and toward the curved diffuser section wall that is located forwardly or downstream of the other nozzle —i.e., the nozzle whose outlet is then at a lower pressure. The stream of fibers then attaches to and follows this curved sidewall of the diffuser, thus directing the fibers toward one side of the supply chute. Shortly after this occurs the pressures at the outputs of the nozzles reverse, and the nozzle which was formally at a lower pressure or vacuum now automatically increases in pressure and, as a consequence, directs the flow of fibers backwardly toward the opposite side of the diffuser section, so that the flow of fibers now follows the other curved section of the diffuser, thus directing fibers toward the opposite sidewall of the supply chute.

This alternate deflection of the stream of fibers occurs repeatedly and automatically as the result of the tubular loop or ring which interconnects the nozzles. Moreover, the legs of the loop or tubular ring interconnecting the nozzles may be lengthened, as by stretching the loop so that the interval of time between the reversal of the flow of fibers is lengthened; and conversely the legs of the loop may be shortened, whereby the interval of time between the change in the direction of the fibers is likewise reduced.

THE DRAWINGS

DETAILED DESCRIPTION OF THE PREFERRED EMBODIMENTS

Figure 1:
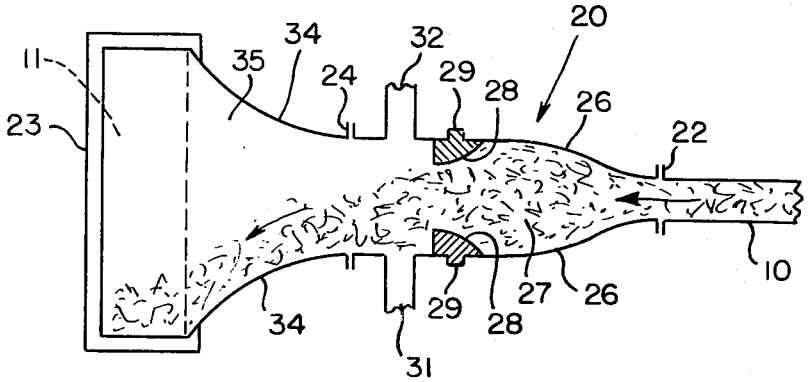
FIG. 1 is a fragmentary plan view illustrating schematically a pneumatic fiber supply system having incorporated therein a leveling device made according to one embodiment of this invention, portions of the duct work being removed for purposes of illustration.
Figure 2:
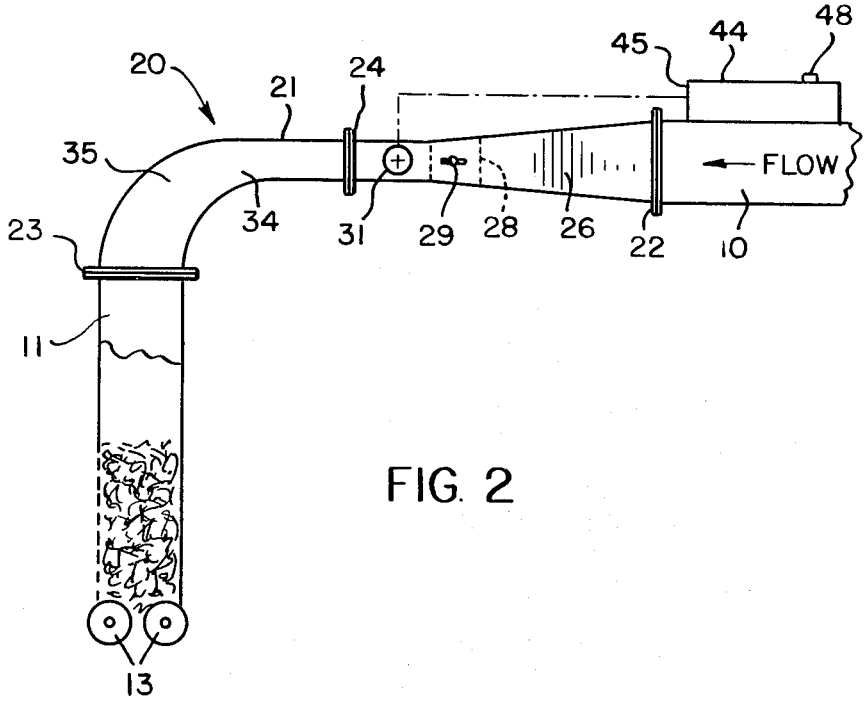
FIG. 2 is a fragmentary side elevational view of the supply system shown in FIG. 1, the system again being shown schematically.

Referring first to FIGS. 1 and 2, 10 denotes a fiber supply or transport duct, which is adapted to be connected at one end (its right end in FIGS. 1 and 2) to a supply of fibers which are conveyed by air under pressure to the upper end or surge section of a vertically disposed fiber supply chute 11 for a carding machine or the like. Chute 11, which may be of the type shown for example in U.S. Pat. No. 4,240,180, is rectangular in cross section and communicates at the lower end of its surge section with a pair of feed rolls 13 for purposes which are set forth in detail in the above-noted U.S. Pat. No. 4,240,180.

Interposed between the duct 10 and the chute 11 is a novel flip-flop unit or fiber leveling device, which is denoted generally by the numeral 20. Unit 20 comprises a specially shaped duct 21, which is rectangular in cross section, and opposite ends of which are secured by conventional flange connections 22 and 23 to duct 10, and to the upper end of chute 11, respectively. In this embodiment duct 21 is shown as two separate sections adjacent ends of which are secured together as at 24 by a conventional flange connection. It will be understood, however, that for the sake of convenience duct 21 could be made in as many different pieces or sections as desired.

Adjacent the transport duct 10 the opposed sidewalls of duct 21 curve outwardly and away from each other as at 26, thereby forming in this end of duct 21 a slightly enlarged chamber or deceleration zone 27 (FIG. 1). Projecting into duct 21 from the inside surfaces of its sidewalls just down stream from the deceleration zone 27 are two, opposed, curved accelerator plates 28, which are similar in configuration. Plates 28 gradually narrow or throttle the space in duct 21 so that the flow of fibers therebetween, will be slightly accelerated , as noted hereinafter.

Secured in the sidewalls of duct 21 just downstream from the accelerators 28 are the discharge ends of two, opposed, registering nozzles 31 and 32, the purpose of which will be described in greater detail hereinafter. Just downstream from the nozzles 31 and 32 the opposed sidewalls of duct 21 again begin to curve outwardly and away from each other as at 34 in order to form in duct 21 a concave diffuser section or transition chamber 35, the outlet end of which (left end in FIGS. 1 and 2) communicates with the upper end of the chute 11. In this embodiment, in addition to having the concavedly shaped sidewalls 34, duct 21 also has top and bottom walls which curve downwardly as shown in FIG. 2 to connect the discharge end of duct 21 with the upper end of chute 11. It is not necessary that the top and bottom walls of duct 21 be curved at this point apart from the fact that duct 21 must curve downwardly to communicate with chute 11. The curved sidewalls 34, on the other hand, do contribute significantly to this invention as noted hereinafter.

Figure 5:
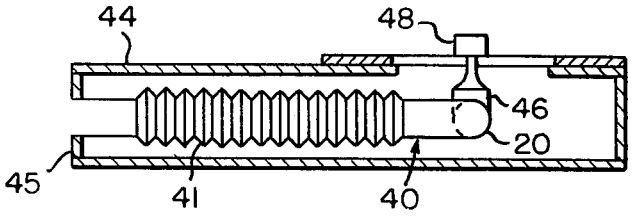
FIG. 5 is a side elevational view of a housing which contains an adjustable ring duct or tube that is employed to interconnect the two jets of the leveling devices made according to this invention, portions of the housing being cut away for purposes of illustration.
Figure 6:
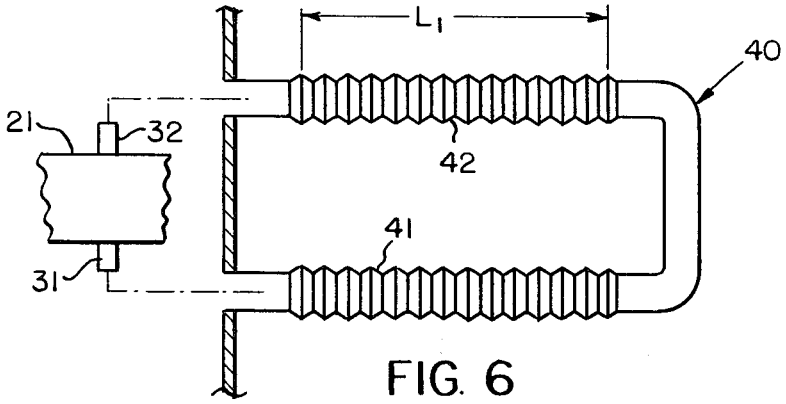
FIGS. 6 and 7 are fragmentary plan views of this ring duct in two different positions of adjustment.
Figure 7:
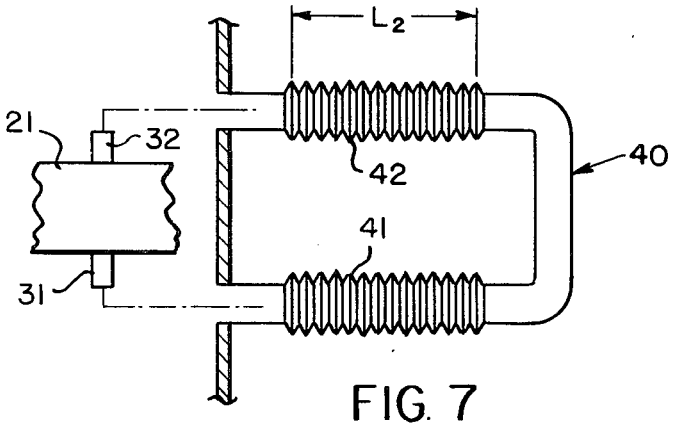

To control the deflection of the flow of fibers through the duct 21 the nozzles 31 and 32 are connected to opposite ends of an elongate, tubular, generally U-shaped ring duct 40, which is adjustably mounted in a housing 44 (FIGS. 2 and 5). Duct 40 has two, spaced, parallel legs 41 and 42, which are pleated intermediate their ends to permit adjustment thereof is noted hereinafter. The open ends of the corrugated duct legs 41 and 42 are secured in the end wall 45 of housing 44, and are connected in any conventional manner to the inlet ends of the nozzles 31 and 32, respectively, as illustrated schematically in FIGS. 6 and 7. The opposite end of duct 40 is adjustably mounted in housing 44 by a slide 46, the upper end of which extends through a slot 47 in the top of the housing and is attached to a knob 48, which is manually operable slidably to adjust the closed end of the duct 40 between different positions of adjustment, two of which are shown in FIGS. 6 and 7, respectively. In practice the housing 44 is adapted to be secured in a stationary position on or near the duct 21; and for purposes of illustration it is shown in FIG. 2 to be mounted on the transport duct 10.

In use, air-borne fibers are blown under pressure through the transport duct 10 and into the right end of the duct 21 as shown in FIGS. 1 and 2. The stream of fibers initially shows down somewhat as it is discharged into the deceleration zone 27, and then is suddenly accelerated as it passes between the accelerators 28 and the confronting ends of the nozzles 31 and 32. If at this point a pulse or jet of air is discharged from one of the nozzles 31 and 32 into the duct 21, and at a time when no corresponding jet is being introduced through the other nozzle, then the stream of fibers will be directed by the jet of air toward the opposite side of duct 21. As shown by the arrows in FIG. 1, for example, if a jet of air is introduced through nozzle 32 the stream of fibers will be directed downwardly in FIG. 1, or toward the side of duct 21 containing the nozzle 31.

With the present invention the two nozzles are connected by the ring duct 40, so that there is no external or separate source for supplying pulses or jets of air selectively to nozzles 31 and 32. However, it has been determined that in practice the pressure at the outlet ends of the respective nozzles 31 and 32 does not remain the same for each nozzle. Instead, when the flow of fibers initially takes place through the duct 21, either one or the other of the nozzles 31 and 32 will have its outlet at a pressure lower than the outlet of the opposed nozzle.

Assuming, for example, that the pressure at the outlet of nozzle 31 initially is lower than that at nozzle 32 (for example at a slight vaccum) then the flow of fibers will be directed downwardly as illustrated in FIG. 1. When this occurs the stream of fibers tends to adhere or cling to the curved transition wall 34 located at that particular side of the duct (the lower side as shown in FIG. 1), and thereby causes fibers to be directed toward the corresponding side of chute 11. Also at this time the pressure at the outlet of nozzle 31 slowly rises, while the pressure at the outlet of nozzle 32 begins to fall. Consequently, within a short period of time the nozzle 32 is at a pressure lower than that of nozzle 31, and the stream of fibers is therefore deflected or otherwise caused to traverse toward the other or upper side 34 of the transition duct as shown in FIG. 1. When this occurs the flow of fibers will tend to cling to the curved sidewall 34 leading from nozzle 32 to the chute 11, so that the fibers will tend to fill this opposite side of chute 11. Shortly thereafter the pressure at the outlet of nozzle 32 will tend automatically to increase to a value above that at the outlet of nozzle 31, and as a consequence the flow of fibers will once again be directed backwardly toward the other side of duct 21 (the lower side in FIG. 1).

In this manner the flow of fibers is automatically and continuously deflected back and forth between opposite sides of chute 11, whereby the density of the column of fibers in chute 11 will be kept uniform, and the upper end of the column will be maintained substantially level at all times.

In practice it is desirable to mount the accelerators 28 for adjustment relative to the nozzles 31 and 32. One way this can be done is to employ a pin, which projects from each accelerator 28 through a slot in the associated duct sidewall, and which has on its outer end an enlarged head 29 by means of which the associated accelerator plate 28 can be adjusted manually relatively to the associated nozzle 31 or 32. Alternatively, or in addition, the accelerators could be mounted to pivot about one edge thereof to adjust the space separating their inner, confronting surfaces.

As previously noted, the ring duct 40 is disposed to be adjusted in its housing 44, for example into any one of a number of positions between the overall distance S (FIG. 7), so that its corrugated leg sections can be adjusted between a maximum length $L_1$ and a minimun length $L_2$. The reason for this adjustment is that it has been determined that the frequency of oscillation of the stream of fibers between opposite sides of the chute 11 (or the diffuser section 35) is dependent upon the length of the ring duct 40. Thus, by adjusting the length of the duct 40 it is possible also to adjust the frequency with which the flow of fibers is deflected back and forth between opposite sides of chute 11. This frequency is affected also by the diameter of the ring duct 40, but since the adjustment of the diameter of this element is difficult to accomplish, the control in the embodiments illustrated has been effected by adjusting the legnth of the ring duct 40.

By way of example, when the lengths of the legs 41 and 42 are maximum, for example as denoted by $L_1$ in FIG. 6, then the delay between the critical pressure changes at the nozzles 31 and 32 is maximum. Conversely, when the length of each leg 41 and 42 is at minimum value of $L_2$ (FIG. 7), the delay between the critical pressure changes at nozzles 31 and 32 is minimum, so that the deflection of the stream of fibers from one side to the other of chute 11 occurs with the greatest frequency. Obviously by adjusting the ring duct into position between its two limit positions, the rate of deflection can be further varied.

Figure 4:
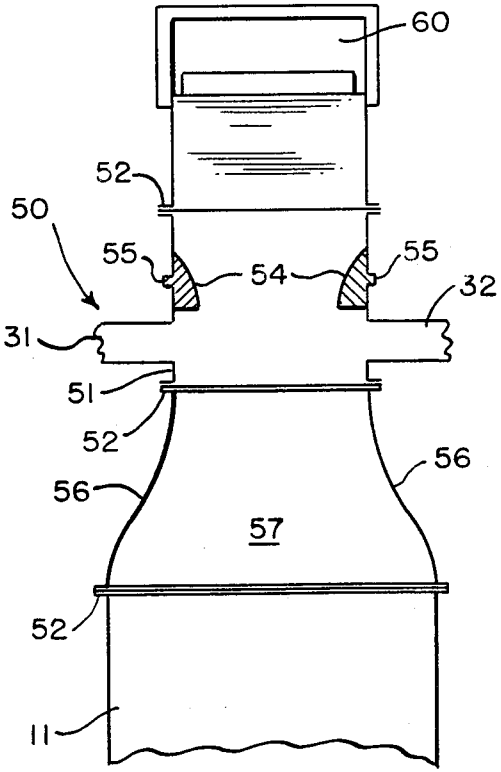
FIG. 4 is a fragmentary sectional view taken generally along the line 4—4 in FIG. 3 looking in the direction of the arrows.
Figure 3:
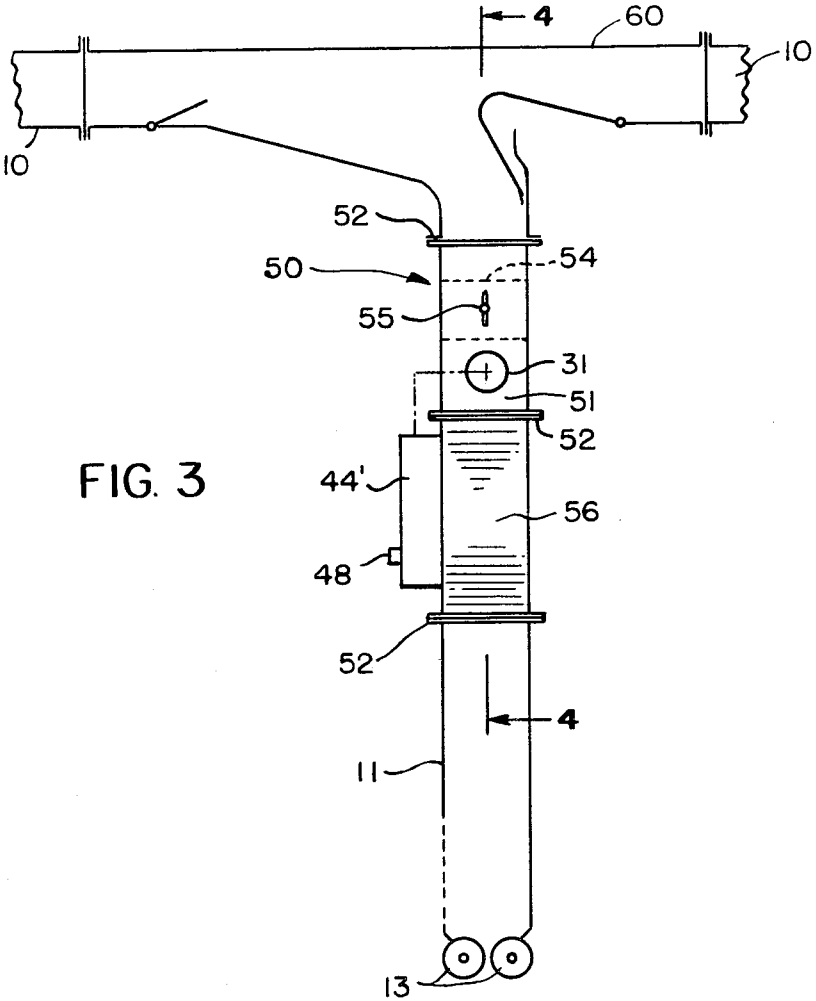
FIG. 3 is a fragmentary side elevational view illustrating schematically a modified form of this fiber feeding system.

Referring now to the embodiment shown in FIGS. 3 and 4, wherein like numerals are employed to denote elements similar to those employed in the first embodiment, 60 denotes a conventional diverter unit, which is incorporated in a transport duct 10 for the purpose of selectively diverting air-borne fibers downwardly from the transport duct to a vertical supply chute 11 of the type described in connection with the first embodiment. In this embodiment 50 denotes a novel flip-flop or leveling unit comprising a connecting duct 51, which is secured at its upper end by a conventional flange connection 52 with the discharge end of the diverter unit 60, and at its lower end by a similar connection 52 with the upper end of the surge section of the chute 11. Although the inlet end of duct 51 is not provided with a special, enlarged deceleration chamber of the type shown in the first embodiment, the slight throttling effect introduced by the discharge end of the diverter unit 60 causes the stream of fibers entering the upper end of duct 51 to be decelerated slightly. The stream of fibers then passes between a pair of opposed accelerator plates 54, which project from the inside surfaces of the sidewalls of duct 51 adjacent its inlet end.

As in the case of the first embodiment, the accelerator plates 54 are mounted for adjustment by means of headed pins 55, and are positioned adjacent to, and slightly upstream from, a pair of deflector nozzles 31 and 32, which are mounted in opposite sides of duct 51 adjacent the discharge edges of accelerators 54. Just downstream from the nozzles 31 and 32 the opposed sidewalls of duct 51 curve outwardly and away from each other as at 56 to form therebetween the diffuser section or chamber 57, the discharge end of which communicates with chute 11.

Although not illustrated in detail on the drawings, the outer ends of these nozzles 31 and 32 are connected, as in the case of the first embodiment, with the legs 41 and 42, respectively, of an adjustable ring duct 40, which is mounted in a housing 44' that is attached to the outer surface of duct 51. As in the first embodiment this duct 40 is adjustable by a pin or knob 48 that is located at the exterior of housing 44'.

In use, the unit 50 functions in the same manner as the previously-described leveling unit 20. For example, as a stream of fibers passes between the accelerator plates 54 it will be deflected toward one side or the other of duct 51 depending upon which of the two nozzles 31 and 32 is at that time at a pressure greater than the other. Assuming that the stream is deflected toward the left side of duct 51 as shown in FIG. 4, then the stream will tend to cling to the inside surface of the left hand transition surface 56, whereby the fibers will be directed toward the left side of chute 11. Shortly thereafter the pressure at nozzle 31 will increase and cause the stream of fibers to be deflected toward the opposite side of duct 51, and past the nozzle 32, which in due course will once again thereafter increase in pressure to deflect the stream of fibers back toward the side of the duct containing nozzle 31. As in the previous embodiment, this rate of deflection of the stream of fibers can be adjusted merely by adjusting the length of legs of the ring duct 40 mounted in housing 44'.

From the foregoing it will be apparent that the present invention provides relatively simple and inexpensive means for accurately and automatically maintaining substantially uniform the density of a column of fibers in a feed chute of the type described. This is effected by causing the stream of fibers to be deflected back and forth from side to side of the feed chute as the fibers enter the chute from the distribution duct. By utilizing the ring duct 40 for interconnecting the two control or deflector nozzles 31 and 32 it is possible automatically to effect this periodic deflection of the stream without the use of any special mechanical or electrical device for controlling reversal of the stream direction. In addition, simply by using the curved diffusion surfaces 34 and 56, the fiber stream can be curved by virtue of the wall attachment phenomenon in order to direct the fibers to each side of the feed chute 11.

Figure 8:
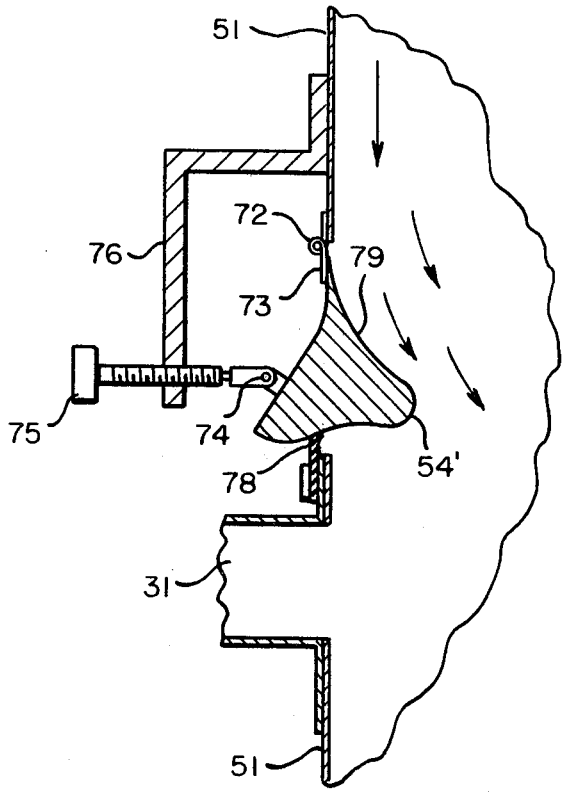
FIG. 8 is an enlarged fragmentary view of a modified form of accelerator plate which can be used with the duct shown in FIG. 4.

As noted above, each accelerator plate, such as for example the modified plate 54' in FIG. 8, could be hinged as at 72 along one edge thereof for pivotal movement in an opening 73 in the sidewall of the connecting duct, such as duct 51. The plate 54' is pivotally connected by a pin 74 to the inner end of an adjusting screw 75 that is threaded in one leg of a bracket 76 that projects from the outer surface of duct 51 adjacent opening 73. The periphery of opening 73 is bounded by a flexible seal 78 to prevent any air loss through opening 73, and yet to permit pivotal adjustment of plate 54' about the axis of hinge 72.

The inner surface 79 of each accelerator plate 54' is curved or inclined inwardly toward the center of the associated duct 51 to create a venturi effect, which is increased and decreased as a pair of confronting plates 54' are adjusted inwardly and outwardly, respectively. This venturi phenomenon will in turn affect the pressures at the outputs of the adjacent nozzles 31 and 32. Adjustment of each plate 54' about its hinge axis need not be great. For example, where the plate is 10% of one half the width of duct 51, the maximum adjustment need only be in the range of 15% of the accelerator plate thickness.

In those instances where the accelerator plates are mounted for sliding adjustment relative to the associated duct and adjacent nozzle, they can be adjusted to compensate for unavoidable asymmetries in the manufactured parts used in the connecting duct, and slight pressure perturbations in the main supply duct. Movement of such an accelerator plate toward and away from the associated feed duct 11 will affect the pressure at the output of the adjacent nozzle, and the boundary layer attachment of the stream of fibers to the adjacent, curved diffuser surface.

Moreover, by mounting the duct 40 for adjustment, it is possible to select the frequency with which a stream of fibers will be deflected back and forth between opposite sides of the feed chute. In pneumatic fiber supplies of the type described it is not at all uncommon to employ feed chutes which are upwardly of 40" in width, and which therefore require careful filling in order to prevent undesirable mounding or concentration of the fibers in the center of the chute. With applicant's novel invention this problem is obviated and readily controlled by improved use and application of boundary layer and jet control principles of the type described, for example, in U.S. Pat. No. 3,567,288.

As used herein the terms nozzle and jet are not intended to require the use of a particularly shaped orifice for discharging a fluid (air) in any particular form or at any particular rate. The openings defined by the discharge ends of nozzles 31 and 32 may be quite large, and need not be of any particular cross sectional configuration. Also it is not absolutely necessary that a stream of fibers decelerate upon entering the connecting duct 21 or 51, but it is important that the streams be acclerated prior to passing nozzles 31 and 32.

While this invention has been illustrated and described in detail in connection with only certain embodiments thereof, it will be apparent that it is capable of still further modification, and that this application is intended to cover any such modifications as may fall within the scope of one skilled in the art, or the appended claims.

What I claim is:

1. Apparatus for pneumatically filling a supply chute with a uniform column of fibers comprising a transport duct for conveying a stream of air-borne fibers from a supply thereof to the upper end of a feed chute for a carding machine or the like, a connecting duct having an inlet end operatively connected to said transport duct to receive a stream of air-borne fibers therefrom, and having an outlet end connected to the upper end of said feed chute, means adjacent the inlet end of said connecting duct for accelerating the stream of fibers entering said connecting duct, deflecting means connected to said connecting duct downstream from said accelerating means and operative intermittently to cause said stream of fibers to be deflected back and forth between opposite sides of said connecting duct, and diffusion means formed in said connecting duct between said deflecting means and said chute and operative to cause said stream of fibers, after deflection thereof toward either side of said connecting duct, to cling to the last-named side of said connecting duct to be guided thereby toward the corresponding side of said chute.

2. Apparatus as defined in claim 1, wherein said diffusion means comprises a pair of opposed, outwardly curving sidewalls formed on said connecting duct between said deflecting means and said chute.

3. Apparatus as defined in claim 1, including means for automatically operating said deflecting means at predetermined intervals of time.

4. Apparatus as defined in claim 1, wherein said accelerating means comprises a pair of spaced accelerator plates projecting from the inside surfaces of the opposed sidewalls of said connecting duct adjacent the inlet end thereof, and operative to cause said stream of fibers to be accelerated upon passing between said plates.

5. Apparatus as defined in claim 4, wherein said deflecting means comprises a pair of nozzles secured in said opposed sidewalls with the discharge ends thereof opening on the interior of said connecting duct downstream of said accelerator plates, and in opposed registry with each other, and means operative intermittently to reverse the air pressure at the outlets of said nozzles thereby to effect intermittent deflection of said stream of fibers.

6. Apparatus as defined in claim 5, wherein the last-named means comprises a tube mounted at the exterior of said connecting duct and having opposite ends thereof connected to the inlet ends of said nozzles.

7. Apparatus as defined in claim 6, wherein said tube is adjustable in length, and said last-named means further comprises means for manually adjusting the length of said tube into one of a plurality of different poisitions, thereby to adjust the frequency with which said stream is deflected back and forth in said connecting duct.

8. Apparatus as defined in claim 5, including means mounting said accelerator plates for adjustment relative to the sidewalls of said connecting duct and the adjacent nozzles.

9. A pneumatic leveling device for the feed chutes of carding machines and the like, comprising a duct disposed to be connected at one end to a pneumatic fiber supply to receive a stream of air-borne fibers therefrom, and adapted to be connected at its opposite end to the upper end of a feed chute to convey fibers thereto, a pair of spaced accelerator plates mounted in said duct adjacent said one end thereof and operative to restrict the cross sectional area of the interior of said duct adjacent said one end, a pair of nozzles communicating with said duct at opposite sides thereof between said accelerator plates and said opposite end of said duct, and said opposite sides of said duct being curved outwardly and away from each other between said nozzles and said opposite end of the duct, and in such manner that the cross sectional area of said duct gradually increases from said nozzles to said opposite end of the duct.

10. A pneumatic leveling device as defined in claim 9, including means mounting said accelerator plates on said duct for adjustment relative thereto.

11. A pneumatic leveling device as defined in claim 9, including means interconnecting said nozzles so that the change in the fluid pressure at the outlet of one nozzle will have a related effect on the fluid pressure at the outlet of the other nozzle.

12. A pneumatic leveling device as defined in claim 11, wherein said means interconnecting said nozzles comprises a ring duct opposite ends of which are connected to the inlets of said nozzles, and means mounting said ring duct for adjustment between first and second limit positions in which the length of said duct differs for each such position.

* * * * *